US006202588B1

(12) United States Patent
Hebrard

(10) Patent No.: US 6,202,588 B1
(45) Date of Patent: Mar. 20, 2001

(54) APPARATUS FOR MARKING THE LOCATION OF SUBMERGED ARTICLES

(76) Inventor: Charles L. Hebrard, P.O. Box 1166, San Andreas, CA (US) 95249

( * ) Notice: Subject to any disclaimer, the term of this patent is extended or adjusted under 35 U.S.C. 154(b) by 0 days.

(21) Appl. No.: 09/386,651

(22) Filed: Aug. 31, 1999

(51) Int. Cl.[7] ..... B63B 22/00
(52) U.S. Cl. ..... 116/209; 441/6
(58) Field of Search ..... 116/209, 210, 116/DIG. 7, DIG. 8, 32; 441/6–10, 83

(56) References Cited

U.S. PATENT DOCUMENTS

| | | | | |
|---|---|---|---|---|
| 1,549,796 | * | 8/1925 | Parsons et al. | 441/9 |
| 2,243,551 | * | 5/1941 | Daly | 441/7 |
| 2,572,676 | * | 10/1951 | Swyers | 441/6 |
| 3,420,206 | | 1/1969 | Pelger, Sr. . | |
| 3,451,079 | | 6/1969 | Hagan . | |
| 4,540,370 | | 9/1985 | Hebert . | |
| 4,919,452 | * | 4/1990 | Cimino | 116/209 |
| 5,000,482 | * | 3/1991 | Cimino | 116/209 |
| 5,163,858 | | 11/1992 | Sumrall . | |

* cited by examiner

*Primary Examiner*—Andrew H. Hirshfeld
(74) *Attorney, Agent, or Firm*—R. Michael West; Boutin, Dentino, Gibson, Di Giusto, Hodell & West

(57) ABSTRACT

An apparatus for marking the location of an article or piece of cargo which has accidentally or intentionally been dropped from a transport vehicle into a body of water. The marking apparatus includes a housing, having a wall portion, movable from a closed position to an open position when a coupler element is decoupled. A tether line and a float are packed within the housing. The tether line has an upper end attached to the float, and a lower end which passes through a lower wall of the housing before it is attached to the article. An activation cable extends between the vehicle and the coupler element on the housing. A median portion of the housing is buckled to a cargo cable, extending between the underside of the transport vehicle and the suspended article. If the article drops from the vehicle, the activation cable immediately pulls upon, and decouples the coupler element. This allows the movable wall portion of the housing to open, exposing the tether line and the float. As the article hits the water and begins to sink, the float and the tether line are deployed. When the article comes to rest on the bottom floor, the tether line extends between the article and the float on the surface of the water, marking the spot where the article is located, for later recovery and salvage.

18 Claims, 4 Drawing Sheets

Fig. 10
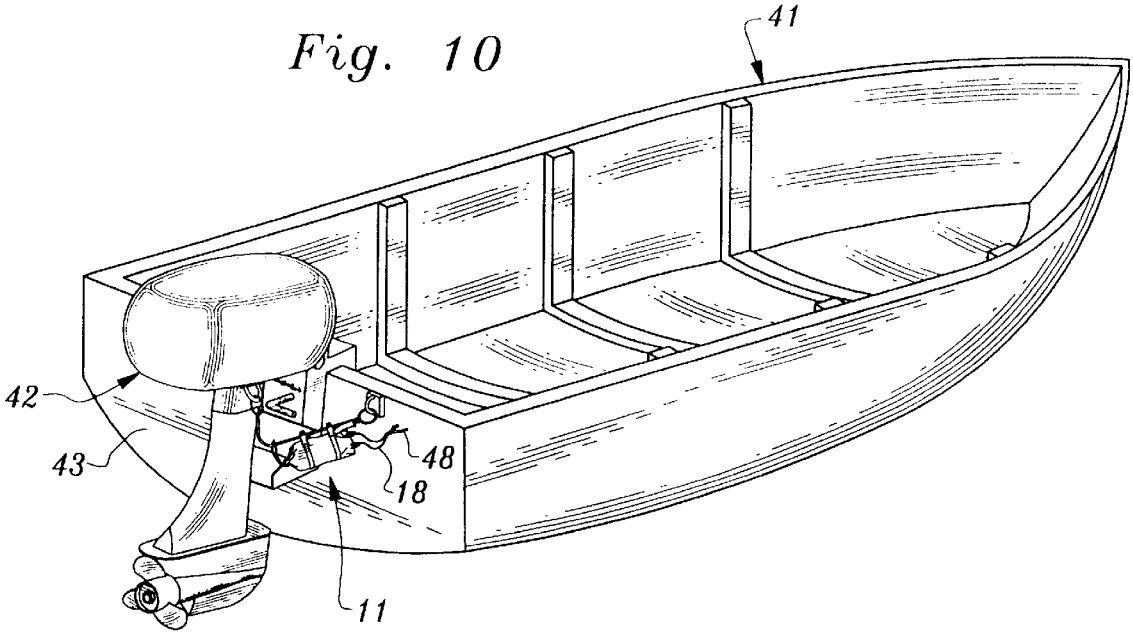
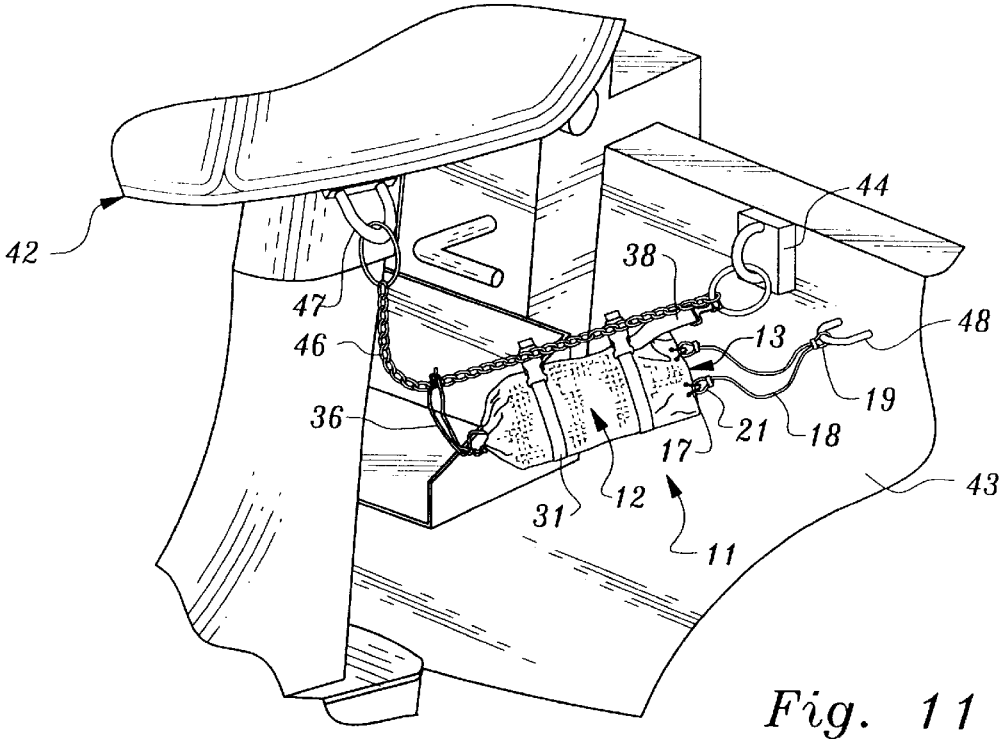
Fig. 11

APPARATUS FOR MARKING THE LOCATION OF SUBMERGED ARTICLES

BACKGROUND OF THE INVENTION

1. Field of the Invention

The invention relates generally to devices for marking the location of an article or a piece of cargo which has been dropped from a transport vehicle into a body of water. More specifically, the invention pertains to a marking apparatus which is useful, for example, in a firefighting application, where a large water carrying bucket is accidentally or intentionally dropped from a helicopter into a lake or pond. The invention may also be used advantageously to mark the location of an inboard or an outboard motor, or heavy water sport accessories, which have fallen off or from a water craft.

2. Description of the Prior Art

The prior art includes a variety of devices for marking the location of submerged objects, so they can later be retrieved and salvaged. For example, in U.S. Pat. No. 4,540,370, a canister is attached to an object, such as a fishing pole. A buoyant canister cap is attached to a retrieval line, stored within the canister. A water reactive chemical is also stored within a portion of the canister. When the object is dropped into water, the chemical reacts with the water, producing a gas under pressure which forces the cap and the line out of the canister. In U.S. Pat. No. 3,420,206, a retrieve/marker for a fishing rod is disclosed. Water soluble glue is dissolved by immersion in the water, and a spring urges the release of a float and an attached tether line. A releasable float for locating and raising sunken objects is shown in U.S. Pat. No. 3,451,079. And, a rescue buoy apparatus is taught in U.S. Pat. No. 5,163,858. However, none of these prior art devices is specially adapted to facilitate the marking of an article or a piece of cargo which is being carried by or is attached to a vehicle, and then becomes separated from same over a body of water.

SUMMARY OF THE INVENTION

The apparatus of present invention includes a housing in which a float and a tether line are stored. One end of the housing is attached to a vehicle, carrying an article or a piece of cargo. The vehicle may be an airplane, a helicopter, or a water craft.

Typically, the housing is attached to the vehicle by means of an activation cord or cable. Where the activation cable attaches to the housing, an operable locking element is provided in combination with a movable wall portion of the housing. The locking element is designed so that when sufficient pulling forces are applied to it by the cable, the element unlocks or breaks, allowing the movable wall portion of the housing to open.

An upper end of the tether line is attached to the float. A lower end of the line preferably passes through a lower wall of the housing, and is securely affixed to the article.

At such time as the vehicle and the article become separated over a body of water, the movable wall portion of the housing, is opened by pulling forces transmitted through the activation cable, thereby exposing the tether line and the float. As the housing and the article sink together, the float and the tether line are deployed. When the article comes to rest on the bottom, the tether line extends between the article and the float on the surface of the water, marking the spot of the article for later recovery and salvage.

By way of example, the apparatus of the present invention may be employed in firefighting applications. In rugged and remote terrains, helicopters are often used to transport water to inaccessible "hot spots." A large water carrying bucket is suspended by a cable, depending from the underside of the helicopter. To fill up the bucket, the pilot hovers over a body of water, such as a lake or pond, and lowers the bucket into the water. Occasionally during this operation, the pilot has control problems, either from a gust of wind, or a sudden loss of power, and the bucket must be immediately detached from the helicopter to regain control. At other times, buckets are simply dropped from the helicopter by accident, over a body of water, when the pilot mistakenly actuates the drop mechanism. In either event, the bucket sinks immediately to the bottom of the lake or pond, and is very difficult if not impossible to locate and salvage later. The present invention may be used to mark the location of such submerged buckets.

The present invention may also be utilized in conjunction with relatively small water craft, powered by an outboard motor. Through vibration from operation, such motors have been known to become loosened from the boat's transom and fall into the lake or pond. Outboard motors have also been accidentally dropped into the water during installation and removal from the boat. In these instances, it is desirable to mark the location of the motor, so that it may quickly be recovered and salvaged.

Also, items resting on the deck of water craft, such as gear boxes and the like, could be fitted with the present marking apparatus to make recovery easy in the event they were washed overboard.

Also, the present invention may be used in connection with high-speed hydroplane water craft. These water craft have been known to break apart and quickly sink, as the result of a flip or other mishap. By attaching the present invention between the large inboard engine and the hull of the water craft, the engine may be located and salvaged.

It is an object therefore, of the present invention to provide a simple and inexpensive means for marking the location of articles, cargo, and engines, which are accidentally or intentionally dropped into a body of water.

It is another object of the present invention to provide a location marking apparatus for sunken articles which may quickly and easily be attached between a vehicle and the article or cargo carried by that vehicle.

It is yet another object of the present invention to provide a marking apparatus for sunken articles which does not rely upon water soluble or water activated chemicals for deployment of its float and tether line.

These and other objects of the present invention will become apparent in the detailed description and the accompanying drawings to follow.

BRIEF DESCRIPTION OF THE DRAWINGS

FIG. 10 is another application for the apparatus of the present invention, showing its attachment between an outboard motor and the transom of a boat; and, FIG. 11 is a detailed drawing of the apparatus as used for the application shown in FIG. 10.

DETAILED DESCRIPTION OF THE PREFERRED EMBODIMENT

Figure 1:
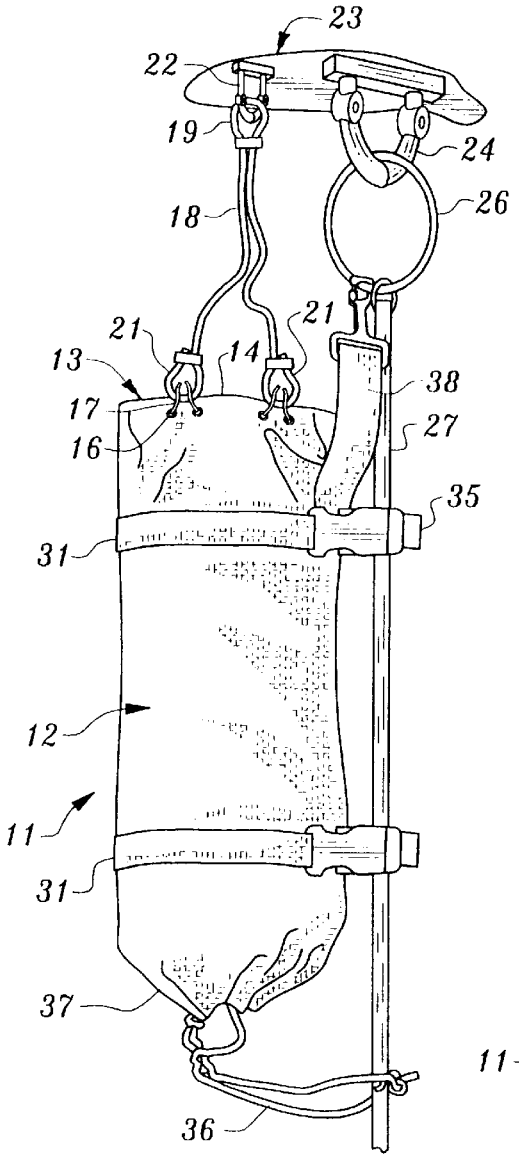
FIG. 1 is a side elevational view of the present apparatus, showing the manner in which the housing is attached both to the underside of an aircraft and to a suspension line for a bucket.

Turning now to FIG. 1, the location marking apparatus 11 of the present invention includes an elongated, right-circular cylindrical housing 12, preferably constructed from nylon fabric, or another easily fabricated material, capable of bing sewn. Other configurations for the housing could be used, although the disclosed configuration conforms well to the general shape of the contained items, facilitating their installation and deployment. It is evident that housing 12 could be manufactured from alternative materials, such as molded plastic or fabricated metal, but the use of such rigid materials would likely increase manufacturing costs, and would provide no significant operational advantages.

Housing 12 has a first wall portion 13, movable from a normally closed position to an open, or activated position. Preferably, first wall portion 13 is located on an upper end of housing 12, so as to facilitate reliable deployment of the marking apparatus as it becomes submerged. However, other locations, sizes, and configurations for the wall portion 13 may be employed, consistent with this deployment objective.

Figure 3:
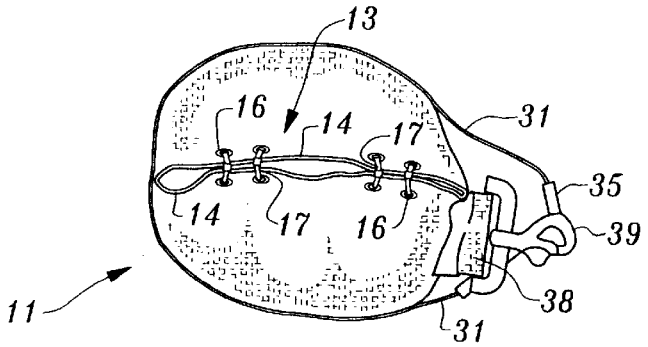
FIG. 3 is a top plan view of the housing.

Wall portion 13 includes opposing upper edges 14, through which plural eyelets 16 are installed. To maintain closure of wall portion 13, at least one locking element 17 is provided, passing through and drawing together corresponding eyelets on the wall portion's upper edges. Applicant has successfully employed frangible plastic tie wraps, formed in a loop configuration, for locking element 17. FIG. 3 shows how four tie wraps may be used as locking elements to close off wall portion 13. However, neither the material, nor the configuration, nor the general mechanical operation of the locking element 17 is critical. The principal requirements are that the element 17 can be released, opened, or broken relatively easily by the application of pulling forces, and that a means for connection be provided on or through the locking element so that the pulling forces can effectively be applied thereto. Other locking means may readily be used in lieu of the plastic tie wraps. Examples would include a mechanism activated by retraction of a pin or by the urging of spring biased latch, a combination of hook and loop materials, or a frangible or detachably coupled wire loop.

An activation cable 18 has an upper end attached to a ring clamp 19, and two lower ends, each fitted with similar ring clamps 21. Ring clamp 19 is hooked through a U-bracket 22, securely affixed to the underside of a transport vehicle, such as a helicopter 23. Ring clamps 21 pass through the loops of locking elements 17, or are otherwise attached to the portion of elements 17 which can be released, opened, or broken.

Figure 2:
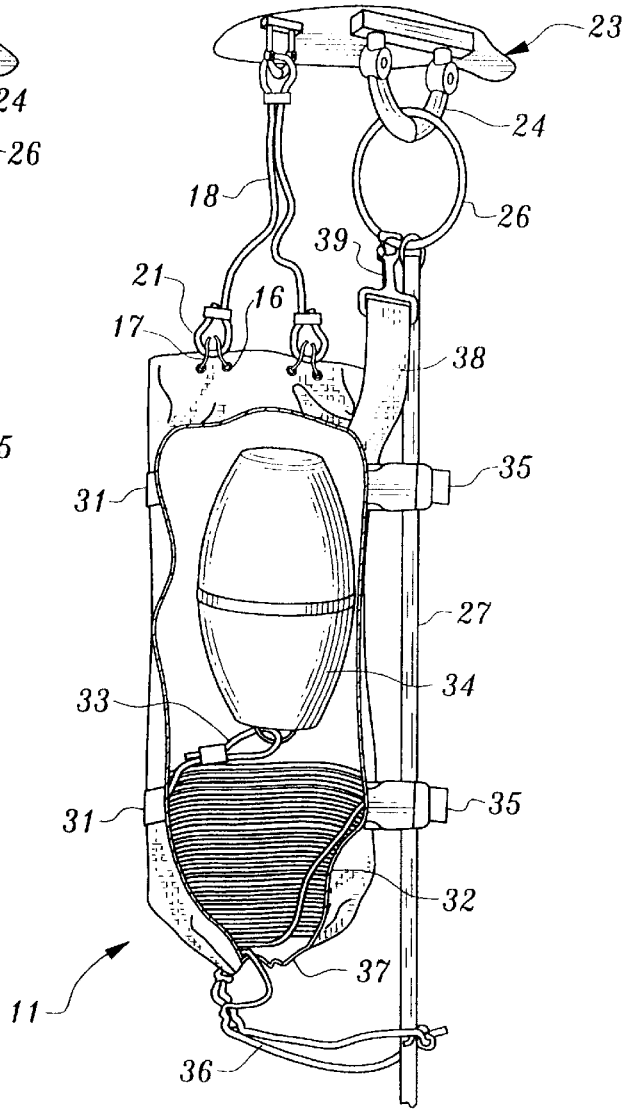
FIG. 2 is a view as in FIG. 1, but with a portion of the sidewall of the housing broken away to show the contained float and tether line.

A cargo hook 24 is also attached to the underside of helicopter 23, adjacent U-bracket 22. Cargo hook 24 has a normally closed position, as shown in FIGS. 1 and 2. In this position, hook 24 is normally engaged with a cargo ring 26, at the upper end of a cargo suspension line 27. A lower end of suspension line 27 splits into four segments 28, each of which is attached, in equally spaced relation, to an upper edge of a water carrying bucket 29. Suspension line 27 may be of any appropriate size and material for the particular application.

Housing 12 is attached to cargo suspension line 27 in three places. The first two attachments are provided by a pair of webbing belts, 31, sewn to housing 12, each extending circumferentially around an intermediate portion thereof. At the ends of each belt 31 are male and female counterparts of a buckle 35. Belts 31 are thereby loosely secured around line 27, essentially to provide a restraint against lateral movement of the housing 12.

A third attachment is provided by a tether line 32. As will be noted particularly in FIG. 2, an upper end 33 of the tether line 32 is connected to a float or buoy 34. A lower end 36 of the tether line, preferably passes through an aperture in a second wall portion 37 in the lower end of the housing 12, and thereafter is connected to cargo suspension line 27. The lower end of line 32 may pass through other portions of the wall of housing 12, but using the lower portion thereof has proven both convenient and effective in reducing the chance of entanglement when the tether line deploys. Also, the lower end 36 may be attached directly to the bucket itself, but for purposes of practicing the invention in this field of application, it is more convenient and equally effective for the lower end of the tether line simply to be connected to the cargo suspension line 27.

Another piece of webbing is used to form a support strap 38, sewn at a lower end to the housing 12 and having a spring-loaded snap connector 39 at an upper end. Snap connector 39 is installed over cargo ring 26 when the apparatus 11 is initially installed. As will be noted from FIGS. 1 and 2, the length of support strap 38 is such that activation cable 18 is normally slack, as strap 38 assumes the entire weight of the housing 12.

Figure 4:
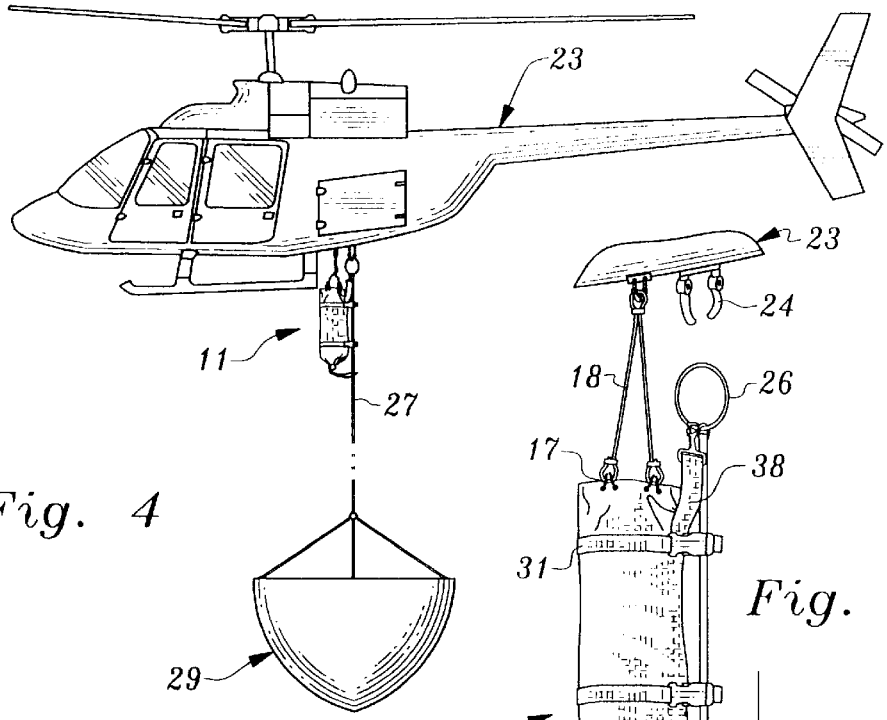
FIG. 4 is a side elevational view of a helicopter carrying a water bucket, showing the marking apparatus installed on the bucket's suspension line.

Turning now to FIGS. 4–7, a sequence of events is depicted in which the apparatus 11 is activated for its function of marking the location of submerged articles. In FIG. 4, the helicopter 23 is shown carrying its cargo, in this case a water bucket 29, used for transporting water to douse "hot spots" in a forest or brush fire. The marking apparatus 11 is normally left attached to the cargo suspension line 27 and the helicopter, at all times when the bucket is in use. During firefighting operations, the helicopter hovers over a body of water, such as a lake or a pond, and lowers and maneuvers the bucket into the water so it will be filled. Then, the helicopter transports the load of water contained in the bucket to a remote location, where the water is dispensed to halt or retard the progress of a fire. This procedure is repeated for as long as is necessary, during the course of fighting the fire.

Figure 6:
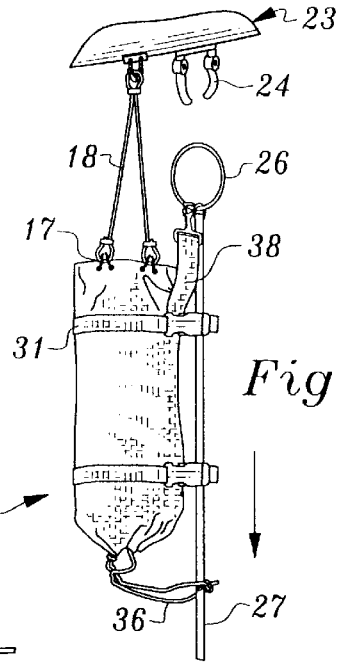
FIG. 6 is a detailed view of the apparatus and associated components as shown in FIG. 5.
Figure 5:
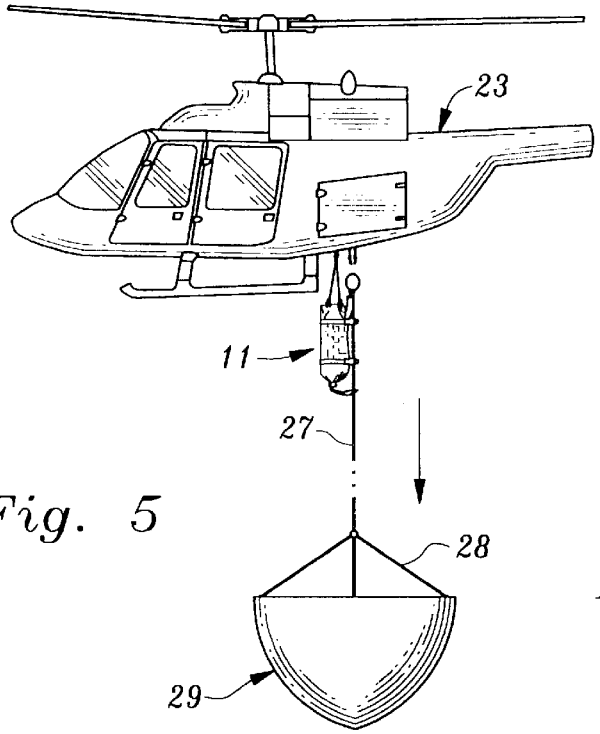
FIG. 5 is a view as in FIG. 4, but with the cargo hook just opened to release the bucket.

Occasionally, however, difficulties are encountered in either loading or transporting the water. For example, inclement weather conditions such as a sudden wind gust, or mechanical problems such as a temporary loss of power, may jeopardize the safety of the pilot and his or her helicopter. Whether this occurs while the water is being picked up from the lake or pond, or during transport of the water, the additional weight of the bucket and the contained water compromises the ability of the pilot to regain control of the helicopter and fly safely. In these circumstances, the pilot has an option to release the bucket from the helicopter, by actuating a special safety release switch in the cockpit of the aircraft. The release switch opens cargo hook 24, as shown in FIGS. 5 and 6. It should also be pointed out that owing to stressful and demanding circumstances, this release switch has occasionally been actuated accidentally by pilots, with the same result.

In any event, irrespective of the circumstances, if the bucket 29 is released over a body of water, it will drop and rapidly sink to the bottom of the lake, pond, or river before the pilot has an opportunity to mark the location for later retrieval. Later, it becomes very time consuming, if not impossible, to locate the lost bucket 29. To remedy the problem of locating and retrieving submerged buckets or other cargo carried by a transport vehicle, the apparatus 11 of the present invention was developed.

Figure 7:
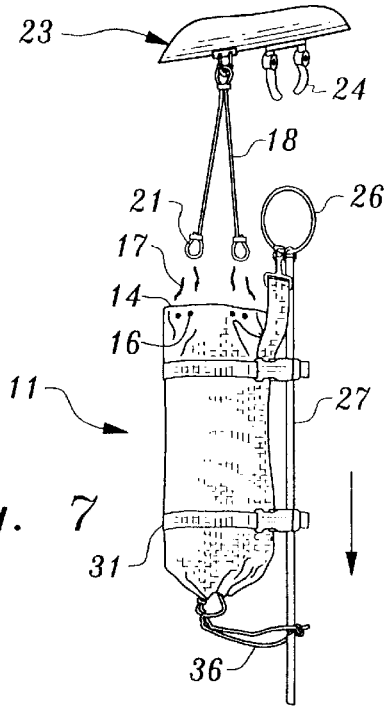
FIG. 7 is a view as in FIG. 6, but illustrating a slightly later moment in time, after the frangible cable ties have broken to open a movable wall portion of the housing.

FIGS. 5 and 6 illustrate the relationship of the helicopter 23 and the previously suspended bucket 29, the moment after hook 24 is opened. In FIG. 6, all of the slack in activation cable 18 has been taken up by the dropping movement of the bucket, and an upward pulling pressure is being applied to locking elements 17. Continued downward movement of the bucket and the attached suspension line 27, results in locking elements 17 being broken, as shown in FIG. 7. At this point, the first wall portion 13 of the housing is no longer restrained, and it is free to move to an open position.

Figure 8:
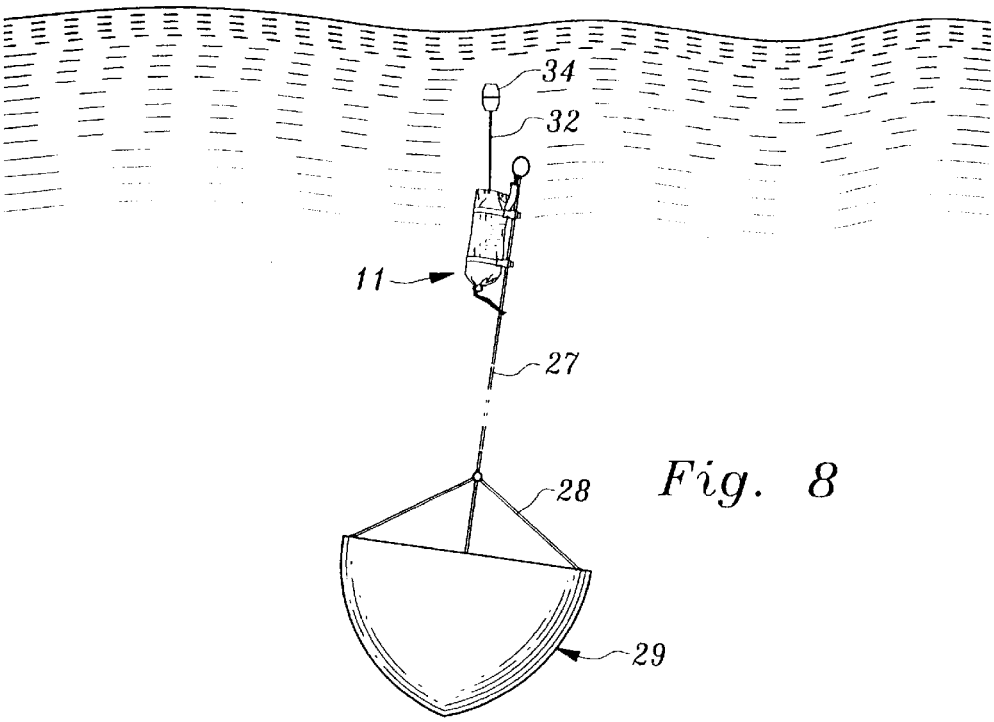
FIG. 8 is an illustration of the bucket and the apparatus shortly after the float and the tether line have begun to deploy.
Figure 9:
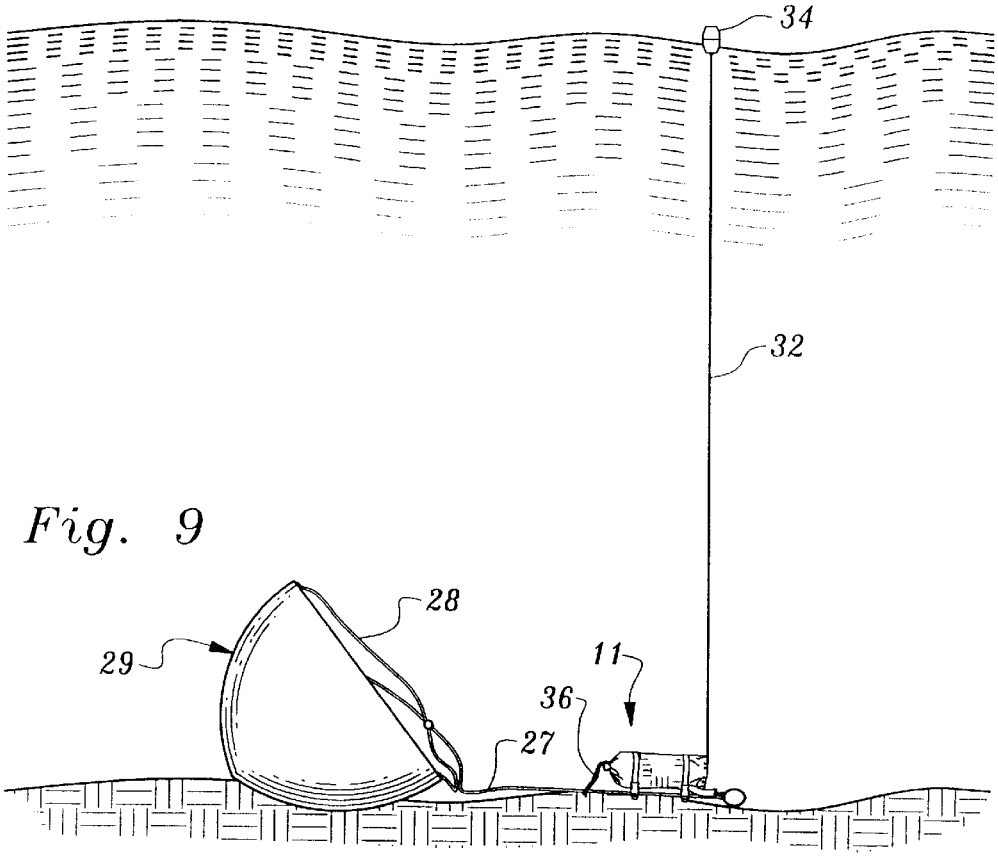
FIG. 9 is an illustration of the bucket on the bottom floor of the body of water, with the float and tether line fully deployed.

It is possible that the float 34 and the tether line 32 may deploy early, depending upon wind conditions and the elevation of the bucket when it is dropped. But in any event, by the time the bucket begins to sink, as shown in FIG. 8, deployment of these marking components has begun. Urged by buoyant forces through the now open wall portion 13, the float rises to the surface of the water, while the tether line plays out until the bucket comes to a rest on the bottom of the body of water (see, FIG. 9). The float 34 is easily located at a later time, by recovery personnel.

Depending upon the strength of the tether line, the weight of the bucket, and the depth of the water, the recovery personnel will either use the tether line to retrieve the bucket directly, or employ divers to attach a stronger recovery line to the bucket for raising it to the surface. For example, ¼" nylon rope has a breaking weight of 1,350 lbs. and should be useful for recovering articles weighing up to 1,000 lbs., suspended in water, leaving a safety margin of 350 lbs.

The apparatus may also be used advantageously for other marine situations, where cargo or other articles, carried by or in a water craft, are accidentally or intentionally dropped overboard, and it is desirable to mark their location for later retrieval. The invention may also be used in circumstances where a hydroplane racing boat literally disintegrates, or partially breaks apart, upon flipping or hitting another boat or a large wave, and it is economically feasible to recover and restore the engine, or use its parts for another engine.

Accordingly, FIGS. 10 and 11 show a representative marine application for the present invention, in which a small boat 41 is powered by an outboard engine 42, mounted on a transom 43. Because many of the components used in this circumstance are identical to those described previously, where possible and appropriate, the same numerical designations will be employed to identify the same components.

Mounted to the after wall of the transom 43 is a U-shaped boat bracket 44. A safety chain 46 extends between bracket 44 and a U-shaped engine bracket 47. Housing 12 is loosely attached to chain 46 by means of belts 31. Also, the lower end 36 of the tether line 32 contained in the housing, is attached to chain 46. Support strap 38 is attached to boat bracket 44, and provides the principal support for the housing 12. The first wall portion 13 of the housing includes locking elements 17, through which ring clamps 21 pass. And, an activation cable 18 is attached to a transom hook 48 by means of a ring clamp 19.

The engine 42 may become accidentally or purposefully detached from the boat 41. For example, vibration may cause the mounting system to loosen when the boat is under power. If the bracket 44 fails from the resultant pulling forces, the engine will sink. Also, in an emergency situation, where the boat is partially submerged and removal of the engine is desirable to make paddling or other rescue efforts more feasible, the chain 46 may be manually detached from bracket 44, to allow detachment of the engine from the boat.

In these circumstances, the apparatus will deploy the float and the tether line in substantially the same manner as that described previously. When sufficient pulling forces are applied to activation cord 18, the locking elements 17 will release the first wall portion 13, allowing it to open. The float and the bulk of the tether line will deploy from the housing, but the lower end 36 of the tether line will remain attached to chain 46. In this manner, the location of the engine 42 will be marked for later retrieval.

Where the present invention is used to mark the location of an inboard engine which has become submerged after the boat has disintegrated or broken apart, it is only necessary that the activation cable extends between the housing and the hull of the boat, and that the lower line 36 of the tether cable be attached to the engine. In other words, there is no need for a cargo suspension line 27, as the engine is actually supported within the hull of the boat itself. In this application, it is the forces directly separating the engine from the hull upon disintegration of the hull which activate the apparatus, rather than forces initiated by actuation of a release mechanism.

It will be appreciated, then, that I have disclosed an apparatus for marking the location of submerged articles and pieces of cargo which have been accidentally or purposefully dropped from an aircraft or a water craft into a body of water, so that those articles or cargo can be retrieved at a later time.

What is claimed is:

1. An apparatus comprising:

a. a housing, said housing having a first wall portion, movable from a closed position to an open position when a locking element on said housing is unlocked;

b. a float;

c. a tether line having an upper end attached to said float, and a lower end passing first through a second wall portion of said housing and then being attached to an article, said float and at least a portion of said tether line being contained within said housing; and, d. an activation cable extending between a vehicle and said locking element on said housing, whereby, when the article becomes separated from the vehicle, said activation cable pulls on said locking element, allowing said first wall portion of said housing to open, exposing said tether line and said float for deployment as the article becomes submerged in a body of water.

2. An apparatus as in claim 1 in which said housing is constructed from a fabric.

3. An apparatus as in claim 2 in which said first wall portion includes an opening having opposing edges with holes therein, and in which said locking element is comprised of at least one plastic loop passing through said holes.

4. An apparatus as in claim 1 in which the article is suspended from the vehicle by means of a cargo suspension line, and including means for attaching said housing to the cargo suspension line.

5. An apparatus as in claim 4 in which said means for attaching includes at least one webbing belt.

6. An apparatus as in claim 1 including a support strap extending from said housing to the vehicle, the length of said support strap being sufficient to provide slack in said activation cable when said support strap is fully extended.

7. An apparatus as in claim 1 in which said first wall portion is located at an upper end of said housing.

8. An apparatus as in claim 1 in which the vehicle is a helicopter and the article is a bucket.

9. An apparatus as in claim 8 including a releasable cargo hook on the underside of the helicopter.

10. An apparatus as in claim 9 in which the bucket is suspended from the helicopter by means of a cargo suspension line extending from the bucket to said cargo hook.

11. An apparatus comprising:

a. a cargo suspension line, said line extending from a bucket carried by a helicopter to a releasable cargo hook on the helicopter;

b. a housing, said housing having a first wall portion, movable from a closed position to an open position when a locking element on said housing is unlocked, said housing being attached to said cargo suspension line;

c. a float;

d. a tether line having an upper end attached to said float, and a lower end passing first through a second wall portion of said housing and then being attached to the bucket, said float and at least a portion of said tether line being contained within said housing; and, e. an activation cable extending between the helicopter and said locking element on said housing, whereby, when the bucket drops from the helicopter, said activation cable pulls on and unlocks said locking element, allowing said first wall portion of said housing to open, exposing said tether line and said float for deployment when the bucket becomes submerged in a body of water.

12. An apparatus comprising a helicopter carrying a water bucket by means of a cargo suspension line, the cargo suspension line extending between the bucket and a releasable cargo hook on the underside of the helicopter, the apparatus further comprising:

a. a housing, said housing having a first wall portion, movable from a closed position to an open position when a locking element on said housing is unlocked;

b. a float;

c. a tether line having an upper end attached to said float, and a lower end passing first through a second wall portion of said housing and then being attached to the cargo suspension line, said float and at least a portion of said tether line being contained within said housing;

d. an activation cable extending between the helicopter and said locking element on said housing, whereby, when said cargo hook is released and the bucket drops from the helicopter into a body of water, said activation cable pulls on and unlocks said locking element, allowing said first wall portion of said housing to open, exposing said tether line and said float for deployment when the bucket becomes submerged in the body of water.

13. An apparatus as in claim 12 in which said housing is constructed from a fabric.

14. An apparatus as in claim 13 in which said first wall portion includes an opening having opposing edges with holes therein, and in which said locking element is comprised of at least one plastic loop passing through said holes.

15. An apparatus as in claim 12 including means for attaching said housing to the cargo suspension line.

16. An apparatus as in claim 15 in which said means for attaching includes at least one webbing belt.

17. An apparatus as in claim 12, including a support strap extending from said housing to the helicopter, the length of said support strap being sufficient to provide slack in said activation cable when said support strap is fully extended.

18. An apparatus as in claim 12, in which said first wall portion is located at an upper end of said housing.

* * * * *